United States Patent [19]

Yakou

[11] Patent Number: 4,776,091

[45] Date of Patent: Oct. 11, 1988

[54] RAZOR WITH BLADE REPLACEMENT CARTRIDGE

[76] Inventor: Regard S. Yakou, 17116 Paseo Hermosa St., P.O. Box 8345, Rancho Santa Fe, Calif. 92067

[21] Appl. No.: 932,310

[22] Filed: Nov. 19, 1986

[51] Int. Cl.[4] ..... B26B 21/52

[52] U.S. Cl. ..... 30/86; 30/47; 206/228

[58] Field of Search ..... 30/40, 40.2, 47, 85, 30/86, 90; 206/228, 352, 354, 356

[56] References Cited

U.S. PATENT DOCUMENTS

| | | | |
|---|---|---|---|
| 1,756,439 | 4/1930 | Schick . | |
| 1,791,550 | 2/1931 | Behrman . | |
| 1,824,203 | 9/1931 | Fisher | 30/86 X |
| 2,281,166 | 4/1942 | De S. Nava . | |
| 3,835,532 | 9/1974 | Petrillo | 206/356 X |
| 4,047,295 | 9/1977 | Francis | 30/40.2 |
| 4,182,031 | 1/1980 | Cecil, Jr. | 30/47 |

*Primary Examiner*—E. R. Kazenske
*Assistant Examiner*—Michael D. Folkerts
*Attorney, Agent, or Firm*—Fulwider, Patton Rieber, Lee & Utecht

[57] ABSTRACT

A razor having a hollow handle housing a cartridge adapted to receive replacement blade units. The cartridge includes channels having specially configured holding portions enabling extraction of a blade unit by a razor head in a manner similar to that used to extract a blade unit from the package in which it was marketed.

8 Claims, 1 Drawing Sheet

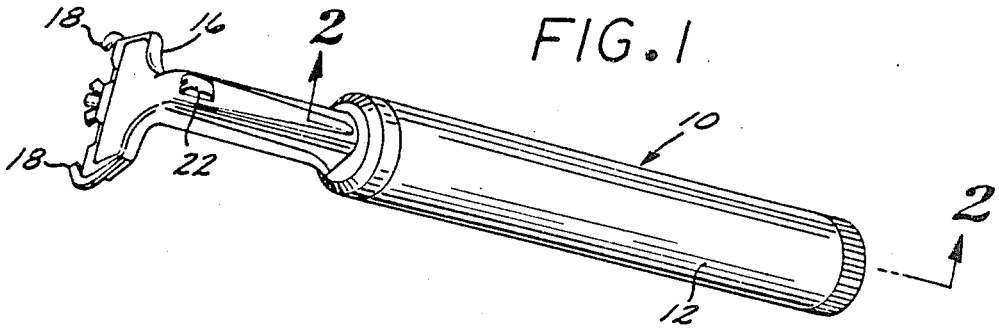
FIG. 1
FIG. 2
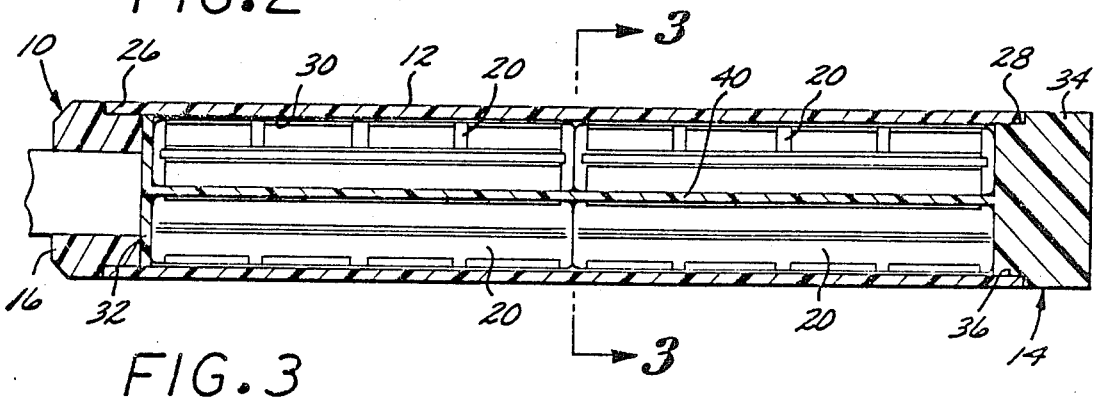
FIG. 3
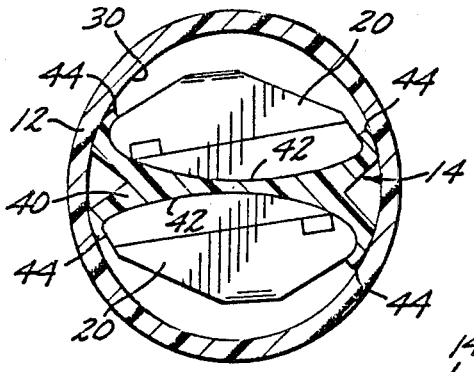
FIG. 4
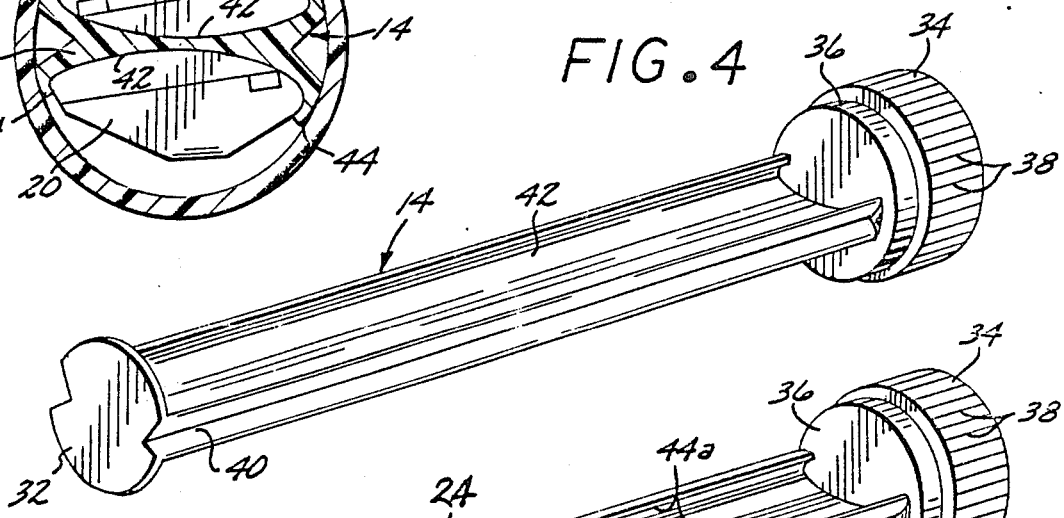
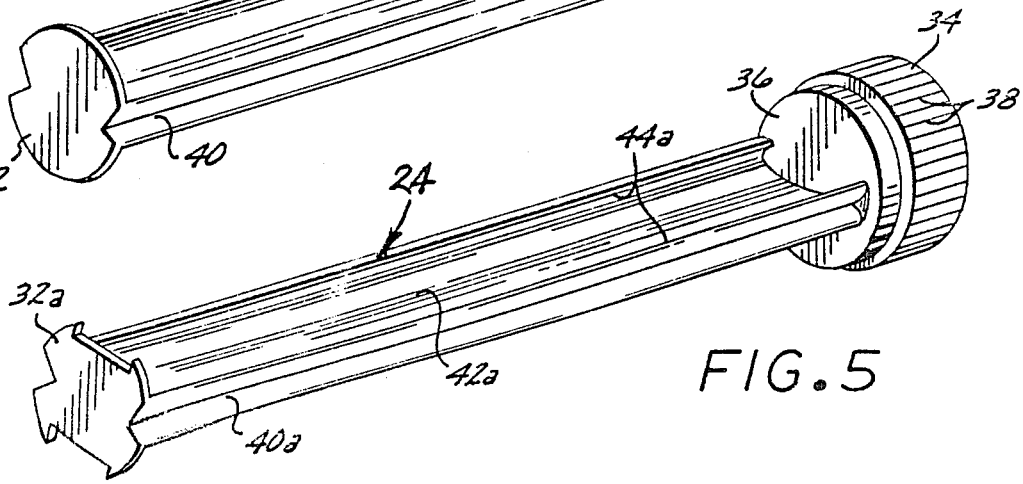
FIG. 5

RAZOR WITH BLADE REPLACEMENT CARTRIDGE

BACKGROUND OF THE INVENTION

1. Field of the Invention

The present invention relates to a shaving razor, and more particularly to a shaving razor having a blade replacement cartridge in its handle.

2. The Related Art

Most current razors utilize a replacement blade unit comprising a compact plastic housing integrally carrying one or more blades. Some of these blade units are a type in which blade housing is pivotably mounted to the razor head by spring loaded pincers. Other blade units are fixed when in use and the blade housing is either laterally slidable into position or is snapped into place and held there by a spring loaded detent mechanism. Both styles of blade unit are typically marketed to the consumer in a plastic package having recesses into which the blade units are pressed. This shields the blade edges from damage and also prevents the consumer from being cut.

A consumer will often forget to bring along a package of replacement blades on a trip; or it will be inconvenient to find room to pack them. In these and other circumstances they never seem to be on hand when they are needed.

Various razors have been developed in the prior art to make replacement blades more conveniently available by storing them in the razor handle. However, most of these are old style razors in which a pack of thin blades are stored, each of which has to be individually handled and slipped onto the razor head. Some are compactly stored in a dispenser device, but these only operate with a special style of razor, and the dispenser is not reusable. None allow the user to mount a replacement blade unit to the razor head in the same manner as he would extract the blade unit from the plastic storage device in which it was marketed, that is, without any need for handling the blade unit with his fingers.

Stacked blades which must be individually handled or manipulated to remove them from the razor handle for mounting to the razor head are shown in U.S. Pat. Nos. 1,791,550, issued Feb. 10, 1931 to M. D. Behrman; 2,281,166, issued Apr. 28, 1942 to R. De S. Nava; and 4,182,031, issued Jan. 8, 1980 to Cecil, Jr. Although U.S. Pat. No. 1,756,439, issued Apr. 29, 1930 to J. Schick discloses a razor in which spare blades are carried within a dispenser that is received within the razor handle, the structure is only suited for a special design of razor and is particularly not adapted to operate with the type of blade units which are most popular today.

SUMMARY OF THE INVENTION

According to the present invention, a razor is provided which includes a hollow handle barrel which receives a cartridge mounting a plurality of replacement razor blade units. The cartridge is particularly characterized by oppositely disposed channels which each receive razor blade units, and each of which are characterized by spaced apart confronting side walls. In addition, holding means carried by the side walls of the channels tightly fit against the razor blade units and develop a frictional constraint preventing inadvertent separation of the razor blade units from the channels.

The unique construction of the channels enables the razor blade head to be utilized to separate a replacement blade from the cartridge in the same manner as the blade head is normally used to extract a blade unit from the plastic container in which such blade units are usually marketed.

The cartridge is adapted to carry enough replacement blade units that only the razor need be taken on an extended trip. Since the blade units are integrally carried by the razor, replacement blade units cannot be lost or overlooked. If desired, the blade unit which is in use can be temporarily stored in the cartridge so that the sharp blade edges are protected and also cannot cut the user during packing for travel.

Other objects an advantages of the invention will become apparent from the following description and the accompanying drawings.

BRIEF DESCRIPTION OF THE DRAWINGS

FIG. 1 is a perspective view of a razor according to the present invention;

FIG. 2 is an enlarged view taken along the line 2—2 of FIG. 1;

FIG. 3 is an enlarged view taken along the line 3—3 of FIG. 2;

FIG. 4 is a perspective view of a replaceable cartridge of a type adapted to accommodate a pivotable type of razor blade unit; and FIG. 5 is a perspective view of a modified replacement cartridge adapted to accommodate a fixed type of razor blade unit.

DESCRIPTION OF THE PREFERRED EMBODIMENT

Referring now to the drawings, and particularly to FIGS. 1–4, a razor 10 is illustrated which, according to the present invention, comprises an elongate hollow handgrip portion or handle barrel 12 adapted to telescopically slidably receive an elongate cartridge 14. The razor 10 is a well known type which integrally mounts a transversely oriented head 16 having gripping elements or pincers 18 adapted to seat within and grip complemental detents (not shown) in a conventional form of razor blade unit 20, as seen in FIG. 3. The pincers 18 hold the blade unit 20 in position and allow it to pivot in conformity with the face of the shaver.

Blade units 20 are normally marketed in compartments of a plastic container or package (not shown) from which they can be quickly removed in a simple prying, snap action. The plastic material of the package flexes slightly to allow this. With the type of razor 10, this is done by pressing a button 22 on the head 16 to move apart the pincers 18 for engagement with the previously mentioned detents in the blade unit. On release of the button 22 the pincers grip and hold the blade unit so that a quick pivotal movement of the razor handle pops the blade unit out of the package without any need to touch it. As will be seen, the cartridge 14 operates in a similar manner to hold blade units with the blade edges disposed inwardly, and allowing them to be individually gripped and removed by the head 16.

Another popular form of razor mounts an integral head which is generally U-shaped in cross-section (not shown). The head includes a pair of confronting flanges or rails adapted to transversely slidably fit within the complemental channel of a fixed type of blade unit (not shown). Interengagement of the rails and channel frictionally constrain the blade unit against inadvertent separation from the razor head. Blade units of this type cannot pivot on the head. This type of blade unit, like the blade units first described, are also conventionally marketed in plastic packages and are individually extracted by similar manipulation of the razor head. As will be seen, the cartridge 24 of FIG. 4 is adapted to receive and store blade units of this type, and cartridges 14 and 24 are interchangeably receivable within the handle barrel 12, according to the style of razor used.

The head end 26 of the handle barrel 12 is integral with the head 16. The opposite or open end 28 of the cartridge defines the entry opening through which cartridge 14 can be inserted for slidable telescopic storage within the hollow interior 30 of the handle barrel 12.

The cartridge 14 includes an inner end wall 32 engaged upon the head 16, and an outer end wall or cap 34 which engages the end 28 of the cartridge to properly axially locate the cartridge in position. The cap 34 includes a reduced diameter portion 36 which frictionally slidably fits within the cartridge end 28 to frictionally constrain the cartridge 14 against inadvertent separation from the handle barrel 12. The exterior of the circular cap 34 is preferably provided with serrations or grooves 38 to facilitate grasping of the cartridge for withdrawing from the handle barrel.

The cartridge 14 includes an elongate central partition 40 which defines laterally oppositely disposed elongate channels 42 which each have a base which is concave in transverse cross-section. Each channel is characterized by opposite, laterally inwardly projecting flanges or rails 44.

The concave base of each channel 42 is adapted to complementally and closely receive the convex surface typical of the pivotable type of blade unit described above, as seen in FIG. 3. In addition, the rails 44 are made of resilient material such as deflectable or deformable plastic which flexes to enable the blade units 20 to be pressed into position on the cartridge 14, and flexes to allow lateral separation of a blade unit in a quick, snap action.

Although not illustrated, axially continuous rails 44 can be made in axially aligned, discontinuous sections. The rails 44 constitute holding means tightly fitting against the razor blade units and developing a frictional constraint which prevents inadvertent separation of the blade units from the channels 42.

In a preferred embodiment, the length of the channels 42 is made such that each channel 42 is adapted to receive a pair of the blade units 20 in end-to-end relation.

In use, when it is desired to replace the blade unit, on the razor head 16, the button 22 is pressed to enable the used blade unit to be discarded. Next, the cartridge cap 34 is grasped to axially withdraw the cartridge 14 from the interior 30 of the handle barrel 12. The razor head 16 is then disposed with its pincers 18 aligned with the detents (not shown) in a replacement blade unit and, as is well known, the seating of the blade unit 20 outwardly projects the button 22 and locks the blade unit in position. Following this, the user pivots the handle barrel 12 in an arc about the central axis of the cartridge 14 until the rails 44 are deflected or deformed the slight amount necessary to unseat the blade unit 20 from the channel 42 within which it is mounted. The cartridge 14 can then be reinserted for use of the razor in the usual manner.

Should the user wish to temporarily remove the blade unit 20 from the razor so that it will not pose a danger when it is packed for travel, the reverse of the foregoing procedure is employed to seat the blade unit in an empty one of the sections of a channel 42, and the button 22 is pressed to release it.

Although plastic material is preferred for the material of the ribs 44, or the whole body of the barrel 12 for that matter, springs or a combination of metal and plastic can also be employed to provide the desired slight movement for seating and unseating of the blade units.

The cartridge 24 (double check #) is substantially identical to the cartridge 14, employing a comparable central elongate partition **40*a* defining oppositely disposed elongate channels 42*a*, and characterized by an inner end wall 32*a* and a cap 34 having a reduced diameter portion 36. The bases of the channels are concave in cross-section, as in the cartridge embodiment of FIG. 4, to receive complementally configured blade units (not shown), but the rails 44*a* project inwardly more sharply than the rails 44 to grip the non-pivotable type of blade unit (not shown). The difference in configuration of the rails 44*a* versus the rails 44 is subtle and not critical to the present invention, FIG. 5 being included to illustrate how the cartridge configuration can be modified to suit the particular nature of the blade units to be stored. Certain manufacturers make both their pivotable and non-pivotable blade units in essentially the same configuration, in which case the cartridge 14 of FIG. 4** could be used for either style of blade unit.

From the foregoing it will be seen that the razor 10 provides an inexpensive means for storing replacement razor blade units in a cartridge which is easily removable for extraction of each replacement blade unit by the razor head in the same manner a blade unit would be extracted by the razor head from the package in which it was marketed. There is no occasion for the user to touch the blades edges themselves. The arrangement eliminates any need for packing a separate supply of replaceable blade units when traveling, and the sharp edges of the replacement blade units are not exposed in such a way that they can cause injury to a person or damage to the blades. The cartridge configuration is convenient and inexpensive to manufacture and can very well be used to market replacement blade units in place of the existing plastic packages in which they are presently marketed. If this were done, the cartridge could be discarded when its blade units are exhausted and a fresh cartridge inserted.

Various modifications and changes may be made with regard to the foregoing detailed description without departing from the spirit of the invention.

I claim:

1. A razor comprising:

a head for removably mounting a razor blade unit;

an elongated hollow handle barrel having one end integral with said head and an opposite open end;

a plurality of replacement razor blade units; and an elongate cartridge telescopically slidably received in said handle barrel and including an end cap which closes said open end and which is grasp able to withdraw said cartridge from said handle barrel, said cartridge further including a central portion extending longitudinally between said cap and the opposite end of said cartridge and having opposite, laterally directed first and second elongate channels which each receive certain of said razor blade units whereby, upon separation of said cartridge from said handle barrel, said cap may be grasped by a user and rotated about the longitudinal axis of said cartridge to present either of said first and second elongate channels to the user for separation of a selected one of said razor blade units from said cartridge, each of said channels having laterally spaced apart, confronting holding means tightly fitting against said razor blade units, and developing a frictional constraint against said razor blade units preventing their inadvertent separation from said channels.

2. A razor according to claim 1 wherein a pair of said razor blade units are disposed in end-to-end relation in each of said first and second channels.

3. A razor according to claim 1 wherein said holding means are made of resilient material deformed for receipt of said razor blade units and for developing said frictional constraint upon said razor blade units, said holding means being further deformable to enable lateral separation of said razor blade units from said channels with a quick snap action.

4. A razor according to claim 3 wherein said cartridge includes an end wall opposite said cap blocking longitudinal slidable separation of said razor blade units from said channels.

5. A razor according to claim 1 wherein said cap includes a reduced diameter portion closely received within said open end of said handle barrel and frictionally constraining said cartridge against inadvertent separation from said handle barrel.

6. A razor according to claim 1 wherein said razor blade units each include a channel, and said holding means comprises a pair of confronting elongate rails engaged in said channel for developing said frictional constraint, said razor blade units being longitudinally slidable on said rails to enable longitudinal separation of said razor blade units from said channels.

7. A razor comprising:

a head for removably mounting a razor blade unit;

an elongated hollow handle barrel having one end integral with said head and an opposite open end; and an elongate cartridge telescopically slidably received in said handle barrel and including an end cap which closes said open end and which is graspable to withdraw said cartridge from said handle barrel, said cartridge further including a central portion extending longitudinally between said cap and the opposite end of said cartridge and having opposite, laterally directed first and second elongate channels which each are adapted to receive a pair of replacement razor blade units in end-to-end relation to each other whereby, upon separation of said cartridge from said handle barrel, said cap may be grasped by a user and rotated about the longitudinal axis of said cartridge to present either of said first and second elongate channels to the user for lateral separation of a selected one of said razor blade units from said cartridge with a quick snap action, each of said channels having laterally space apart, confronting holding means made of resilient material deformable to tightly fit against and develop a frictional constraint upon razor blade units in said channels to prevent their inadvertent separation from said channels.

8. A razor blade for telescopic receipt within the open end of a razor handle barrel, said cartridge comprising:

a cartridge body including a cap to close the open end and which is graspable to withdraw said cartridge from the razor handle barrel, said cartridge body further including a central portion extending longitudinally between said cap and the opposite end of said cartridge and having opposite, laterally directed first and second elongate channels which each are adapted to receive replacement razor blade units whereby, upon separation of said cartridge from said handle barrel, said cap may be grasped by a user and rotated about the longitudinal axis of said cartridge to present either of said first and second elongate channels to the user for separation of a selected one of said razor blade units from said cartridge, each of said channels having laterally spaced apart confronting holding means made of resilient material deformable to tightly fit against and develop a frictional constraint upon razor blade units to prevent their inadvertent separation from said channels.

* * * * *